US006298495B1

(12) United States Patent
Totani

(10) Patent No.: US 6,298,495 B1
(45) Date of Patent: Oct. 9, 2001

(54) HAT INCLUDING GLASSES RETAINING MECHANISM

(75) Inventor: Masahiro Totani, Tokyo (JP)

(73) Assignee: Mate & Co., Ltd. (JP)

( * ) Notice: Subject to any disclaimer, the term of this patent is extended or adjusted under 35 U.S.C. 154(b) by 0 days.

(21) Appl. No.: 09/438,916

(22) Filed: Nov. 12, 1999

(30) Foreign Application Priority Data

Nov. 12, 1998 (JP) ..... 3059053

(51) Int. Cl.[7] ..... A42B 1/24

(52) U.S. Cl. ..... 2/209.13; 2/10; 2/181; 2/195.1; 351/155

(58) Field of Search ..... 2/10, 209.13, 195.1, 2/181, 181.2, 182.1, 422, 13, 209.7, 209.14, 175.1, 175.4; 351/155

(56) References Cited

U.S. PATENT DOCUMENTS 857,838 * 6/1907 Shaw ..... 2/10
1,832,747 * 11/1931 Spoljarich ..... 2/10
2,237,639 * 4/1941 Spoljarich ..... 2/10
3,703,750 * 11/1972 Irwin, Jr. ..... 2/10
4,040,123 * 8/1977 Williams ..... 2/10
4,179,753 * 12/1979 Aronberg et al. ..... 2/10
5,649,327 * 7/1997 Crewe ..... 2/209.13
5,799,334 * 9/1998 Griffith et al. ..... 2/195.1
5,860,167 * 1/1999 Lizio ..... 2/209.13
5,894,604 * 4/1999 Crabb et al. ..... 2/209.13
5,898,935 * 5/1999 Davis ..... 2/209.13

FOREIGN PATENT DOCUMENTS 54-137421 3/1953 (JP) .
1-153337 10/1989 (JP) .

* cited by examiner

*Primary Examiner*—Amy B. Vanatta
(74) *Attorney, Agent, or Firm*—Oldham & Oldham Co., L.P.A.

(57) ABSTRACT

A hat is provided with an insertion hole adapted to permit a temple of a pair of glasses to be inserted therein, positioned in each lateral side of the edge portion of the crown of a hat. The hat is so formed as to permit the temples of the glasses to be positioned between the crown and the slip band that is provided along the inner surface of the edge portion of the crown.

5 Claims, 2 Drawing Sheets

HAT INCLUDING GLASSES RETAINING MECHANISM

BACKGROUND OF THE INVENTION

The present device relates to a cap or other kind of hat which has a brim and permits a pair of glasses, such as sunglasses, to be attached thereto.

It has long been fashionable for young people to put sunglasses on the brim of a cap. However, a cap or a hat which has a means to hook or otherwise attach sunglasses thereto has not yet been invented.

Therefore, sunglasses merely placed on the brim of a hat, such as a cap, are unstable and easy to fall off.

SUMMARY OF THE INVENTION

To enable glasses, such as sunglasses, to be securely placed on the brim of a hat. A hat is provided with an insertion hole adapted to permit a temple of a pair of glasses to be inserted therein, positioned in each lateral side of the edge portion of the crown of a hat. The hat is so formed as to permit the temples of the glasses to be positioned between the crown and the slip band that is provided along the inner surface of the edge portion of the crown.

In order to solve the above problem, an object of the device under the present application is to provide a hat which makes it difficult for sunglasses placed thereon to be inadvertently displaced therefrom.

In order to attain the aforementioned object, the device under the present application calls for provision of at least one insertion hole in each lateral side of the edge portion of the crown of a hat so as to insert the temples of a pair of glasses through the insertion holes. The hat permits the temples to be positioned between the crown and the slip of the hat that is provided along the inner surface of the edge portion of the crown, or adjacent the wearers head.

DETAILED DESCRIPTION OF THE INVENTION

Figure 1:
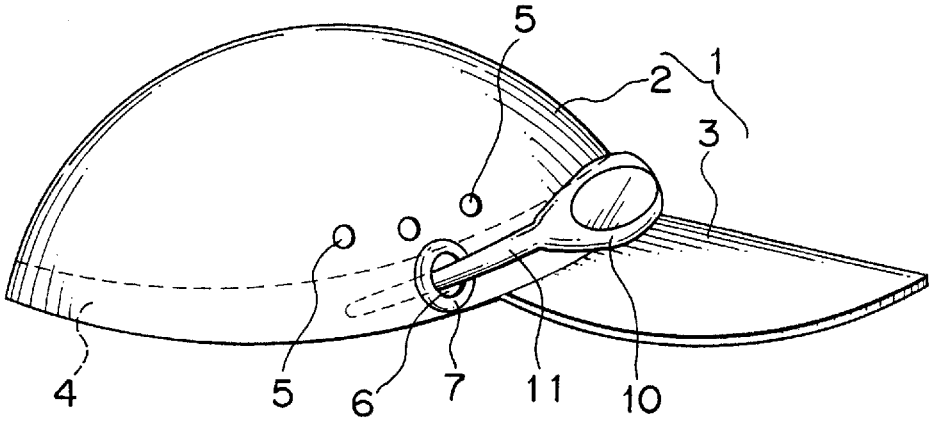
FIG. 1 is a side view of a cap according to the present device.
Figure 2:
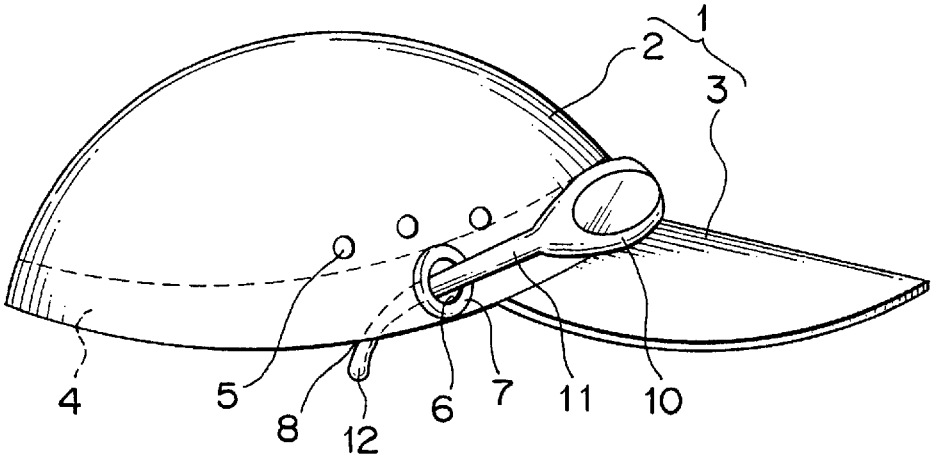
FIG. 2 is a side view of a cap according to another embodiment of the present device.
Figure 3:
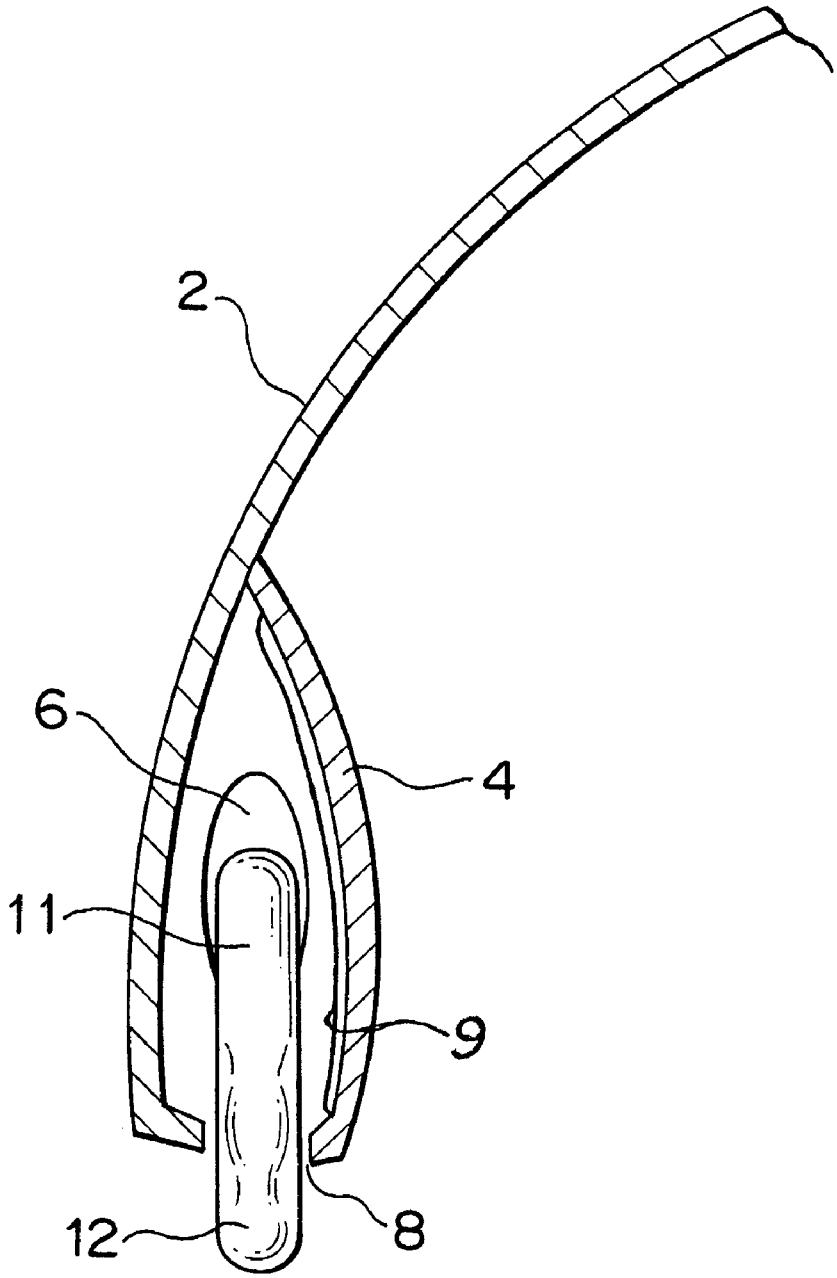
FIG. 3 is an enlarged vertical sectional view of the principal part of said embodiment.

Next, the present invention is explained in detail hereunder, referring to an embodiment thereof shown in the drawings.

Numeral 1 denotes a cap or other headwear which serves as the hat referred to in the claims and other part of the specification. The cap 1 consists of a crown 2 and a brim 3 attached to the front portion of the edge of the crown 2. A slip band 4 which is adapted to come into contact with the head of the wearer is normally attached to the inner surface of the edge portion of the crown and extends along the edge portion so that the cap gets to fit well to the head. Small ventilating holes 5, 5 . . . are generally bored in each lateral side of the crown 2.

At least one insertion hole 6 adapted to permit a temple 11 of a pair of glasses (sunglasses) 10 to be inserted therein is provided in each lateral side of the edge portion of the crown 2, at a location near the corresponding lateral end of the brim 3. It is recommended to encircle the rim of each insertion hole 6 with a decorative ribbon 7, a piece of cloth 7 or the like so as to improve its appearance. Alternatively, the rim of holes 6 could be provided with a hard protective covering 7 and/or a covering which would frictionally engage the temple portions 11 to retain glasses 10 therein. The upper end of the slip band 4 may be sewed to the crown 2 at the two locations where the temples 11 of the glasses 10 are respectively positioned so that each portion of the cap 1 to retain a temple 11 is formed into a pocket.

Furthermore, a protrusion hole 8 may be formed at the lower end of each lateral side of the edge portion of the crown 2 so that the cap 1 is capable of receiving glasses 10 whose temples 11 have curved ends, i.e., ear rests, 12.

Two pieces of embossed cloth 9 are sewed or otherwise attached to the slip band 4, each piece of embossed cloth 9 located where the slip band 4 comes into contact with each respective temple 11 of the glasses 10.

When in use, a pair of glasses 10 are placed on the brim 3, and the temples 11 are inserted into the insertion holes 6 bored in the crown 2 so that the temples 11 are position between the crown 2 and the slip band 4.

Although the device is explained referring to the above embodiment that concerns a cap, it is to be understood that the device is applicable to any other kind of hat or headwear.

As described above, according to the device under the present application, an insertion hole adapted to permit a temple of a pair of glasses to be inserted therein is bored in each lateral side of the edge portion of the crown of a hat, and the hat is so formed as to permit the temples of the glasses to be positioned between the crown and the slip band that is provided inside the crown of the hat. Therefore, the present device not only enables glasses to be placed on the brim of the hat securely but also prevents deformation of the crown, because the sides of the crown will not be pressed by the temples of the glasses.

The device may also include protrusion holes that are respectively formed at the lower ends of the lateral sides of the edge portion of the crown and permit the ends of the temples of glasses to protrude therefrom, the device is applicable to glasses whose temples have curved ends. Alternatively, two pieces of embossed cloth are attached to the slip band, each piece of embossed cloth located where the slip band comes into contact with each respective temple of glasses. Therefore, even if the hat is at a portion angled downward, the temples are prevented from slipping. Thus, the device according to this embodiment is capable of preventing inadvertent displacement of glasses.

What is claimed is:

1. A hat comprising:

a crown having two lateral sides, and at least one insertion hole provided in each of said two lateral sides at an edge portion of the crown, said insertion holes being positioned to permit the temples of a pair of glasses to be respectively inserted therein to a predetermined position; and a slip band formed at a lower edge of the crown and provided inside the crown of the hat so that the temples of tile glasses inserted into said insertion holes can be positioned at said predetermined position between the crown and said slip band of the hat.

2. A hat as claimed in claim 1, wherein each of said lateral sides has a lower end, wherein a protrusion hole is formed at each of said lower ends, said protrusion hole permitting the and of each respective temple of the glasses to protrude therefrom.

3. A hat as claimed in claim 1, wherein two pieces of embossed cloth are attached to said slip band, each piece of embossed cloth located where the slip band comes into contact with each respective temple of the glasses.

4. A hat comprising:

a crown portion and a bill portion, wherein said crown portion has at least one insertion hole provided in a position adjacent each side edge of said bill in a location to accept a temple piece of a pair of glasses on each side of said crown portion, a slip band positioned at a lower edge of the crown portion, such that a temple of said glasses inserted into one of said insertion holes is frictionally engaged between a portion of said crown and a portion of said slip band.

5. A hat as claimed in claim 4, further comprising at least one protrusion hole formed in a lower edge of said crown portion to allow the end portion of a temple piece to protrude therefrom.

* * * * *